US005704843A

United States Patent [19]

Oosterlaak et al.

[11] Patent Number: 5,704,843

[45] Date of Patent: Jan. 6, 1998

[54] BOWLING ACCESSORY

[76] Inventors: Graham K. Oosterlaak, 12 Casorel, Primula Street, Moreletta Park, Pretoria, Gauteng Province; Paul Pisecny, 14 Rooihout Street, Brakpan, Gauteng Province, both of South Africa

[21] Appl. No.: 655,618

[22] Filed: May 30, 1996

[30] Foreign Application Priority Data

Oct. 19, 1995 [ZA] South Africa ..... 95/8814
Nov. 23, 1995 [ZA] South Africa ..... 95/9952

[51] Int. Cl.[6] ..... A63B 37/00

[52] U.S. Cl. ..... 473/128; 473/130

[58] Field of Search ..... 473/128, 129, 473/130

[56] References Cited

U.S. PATENT DOCUMENTS 2,263,052 11/1941 Ross ..... 473/128
2,859,039 11/1958 Jerome ..... 473/128
3,113,775 12/1963 Taylor ..... 473/130
3,342,488 9/1967 Novatnak ..... 473/130
4,699,380 10/1987 Mace ..... 473/130
5,172,910 12/1992 Ashurst ..... 473/128

FOREIGN PATENT DOCUMENTS 0461696 12/1949 Canada ..... 473/128
0019182 12/1928 Netherlands ..... 473/130

*Primary Examiner*—William M. Pierce
*Attorney, Agent, or Firm*—Marshall, O'Toole, Gerstein, Murray & Borun

[57] ABSTRACT

An insert for the thumb or finger holes of a bowling ball is provided. The insert has a thumb or fingerpad of a material selected to provide good grip. The remainder of the insert is of a material selected to allow the unimpeded withdrawal of a thumb or finger from the hole when the ball is released.

25 Claims, 2 Drawing Sheets

BOWLING ACCESSORY

FIELD OF THE INVENTION

This invention relates to a thumb grip, more particularly a grip for use in bowling balls.

BACKGROUND TO THE INVENTION

Ten pin bowling is a popular sport and requires considerable skill to be successful. Whilst playing skills can be improved through practise, they can also be enhanced through use of quality equipment.

The technique required to properly throw the ball is important. As important, is the grip the bowler uses when throwing and releasing the ball. The ball is gripped, most often, using the thumb and two fingers, which are inserted into thumb and finger holes in the outer surface of the ball.

As grip is so important, the material of which the ball is made often proves unsatisfactory to high level bowlers. For this reason inserts are available which are used to line the holes. The inserts are made of a material which gives a better grip than the material of which the ball is made. Commonly such inserts are sold as solid plugs which are then drilled to provide a hole of a diameter most suitable to the bowler's fingers and thumbs. Alternatively, the plugs are provided as an insert, having a preformed hole therein.

While the inserts currently available go a long way to providing a better grip, it is still necessary for highly competitive bowlers to tailor the grip provided. This is done in a number of ways, one of these being to control the finish on the surface of the hole, with a rougher surface providing greater grip than a smoother surface. The problem with this method, however, is that a too rough surface tends to abrade the skin on the outer surface of the thumb or finger when the grip is released and the thumb or finger slides out of the ball, whilst too smooth a finish provides insufficient grip.

Another method used to enhance grip is to apply tape longitudinally to the wall of the hole until the thumb or finger fits snugly. The problem with this method is that the tape does not last and it is often difficult to finely tailor the hole in this way.

In this invention the term "thumb" includes fingers, and the terms "plastics materials" includes, but is not limited to, urethanes, rubbers and PVCs.

OBJECT OF THE INVENTION

It is an object of this invention to provide a bowling accessory which at least partially alleviates some of the problems mentioned above.

SUMMARY OF THE INVENTION

In accordance with this invention there is provided a bowling accessory for a bowling ball comprising a body insertable into a hole in a bowling ball and having a thumb opening therein, the opening having a thumb pad of a first material, the first material being selected to provide a predetermined degree of tactile friction to the removal of a thumb from the opening when an operative grip is assumed on the bowling ball, and the remainder of the opening being of at least a second material.

A further feature of the invention provides for the second material to be selected to provide a predetermined degree of resistance to the insertion of a thumb into, or withdrawal of a thumb from the opening.

A still further feature of the invention for the first material and the second material to be plastics materials.

There is also provided for the first material to be selected to provide at least some of the predetermined degree of tactile friction, by reason of the hardness of the material; for the first material to have a Shore scale hardness of between 40A and 120A, and preferably between 60A and 80A; and for the first material to be urethane based.

A yet further feature of the invention provides for the second material to be selected to provide at least some degree of resistance by reason of the hardness of the material; for the second material to have a Shore scale hardness of between 50D and 90D, preferably between 60D and 80D; and for the second material to be urethane based.

Preferably the body is circular in cross section, and the body is wholly made of the first and the second material, with the pad extending from the inner surface of the opening to the outer surface of the body.

The pad may extend the length of the thumb opening, or alternatively may extend for a portion of the length of the body.

The invention also provides a plug for insertion, in use, into a hole in a bowling ball and in which a thumb opening having a thumb pad can be provided, comprising a first portion and a second portion, the first portion being of a first material selected to be suitable for a thumb pad having a predetermined degree of tactile friction to the removal of a thumb from the opening when an operative grip is assumed on the ball, and the second portion being of at least a second material.

A further feature of the invention provides for the second material to be selected to provide a predetermined degree of resistance to the insertion of a thumb into, or withdrawal of a thumb, from the opening.

Preferably the first material is selected to provide at least some of the predetermined degree of tactile friction, by reason of the hardness of the material.

There is provided for the first material to have a hardness on the Shore scale of between 40A and 120A, and preferably between 60A and 80A.

The first and second material may be urethane based.

Also preferably, the second material to be selected to provide at least some degree of resistance by reason of the hardness of the material.

The second material may have a hardness on the Shore scale of between 50D and 90D, and preferably between 60D and 80D.

The invention extends to a bowling ball having thumb openings characterised in that at least one opening has located therein a thumb pad, the thumb pad being of a first material selected to provide a predetermined degree of tactile friction to the removal of a thumb from the opening when an operative grip is assumed on the bowling ball, and the remainder of the opening being of at least a second material.

Preferably the second material to be selected to provide a predetermined degree of resistance to the insertion of a thumb into, or withdrawal of a thumb from the opening.

The first material and the second material are preferably removably inserted in each thumb opening.

There is provided for the first material to be selected to provide at least some of the predetermined degree of tactile friction, by reason of the hardness of the material.

The first material may have a hardness on the Shore scale of between 40A and 120A, and preferably between 60A and 80A.

The first material and the second material are preferably urethane based.

There is provided for the second material to be selected to provide at least some degree of resistance by reason of the hardness of the material.

The second material may have a hardness in the Shore scale of between 50D and 90D, and preferably between 60D and 80D.

DESCRIPTION OF THE DRAWINGS

Preferred embodiments of the invention are described below, by way of example only, and with reference to the accompanying drawings, in which.

DETAILED DESCRIPTION OF THE DRAWINGS

Figure 1:
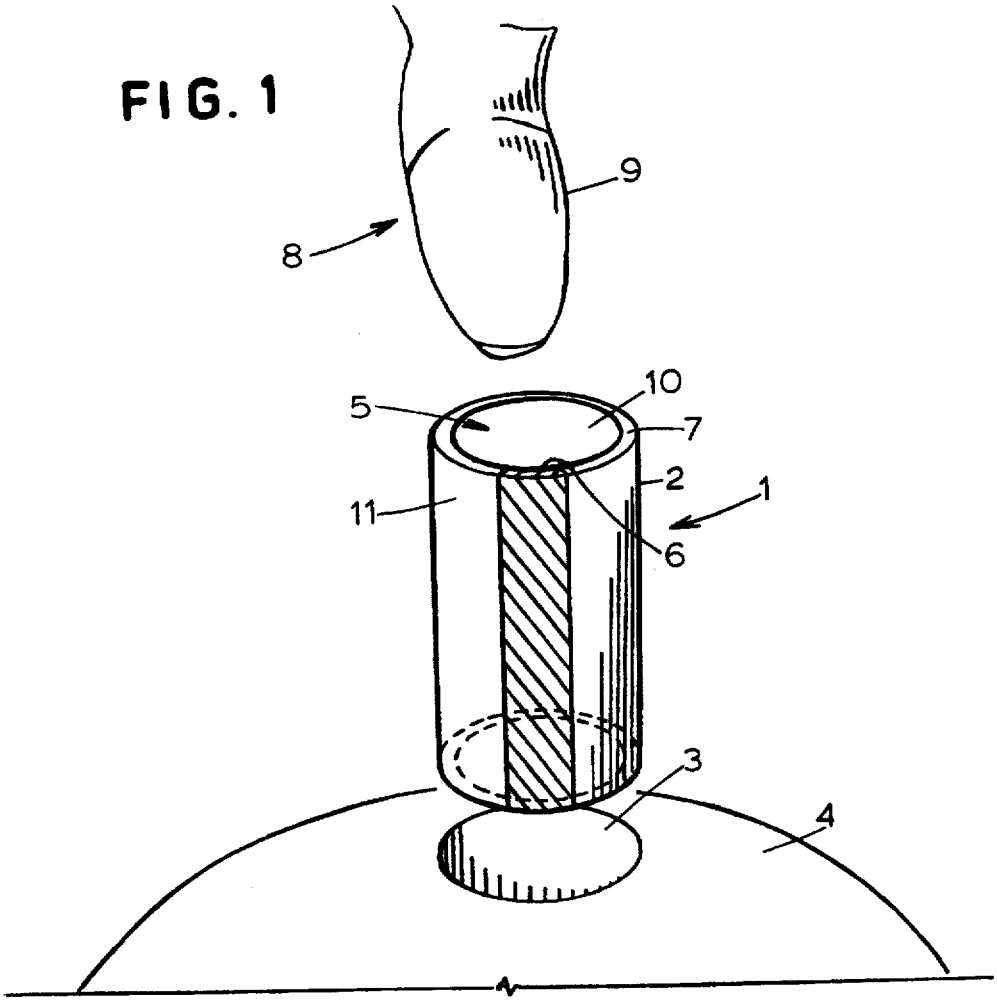
FIG. 1 is an isometric view of a first embodiment of a thumb or finger grip and a bowling ball.

A thumb or finger grip (1) is shown in FIG. 1 and comprises a right circular cylindrical body (2) which is insertable into a hole (3) in a bowling ball (4). The body (2) has a thumb or finger opening (5) therein, with a thumb or finger pad (6) in the body wall, which is made of a first material. The remainder (7) of the body is made of a second material.

The thumb or finger pad (6) forms a strip running the length of the body (2) and extends from the inner surface (10) of the opening (5) to the outer surface (11) of the body (2).

In use, the body (2) is inserted into the hole (3) in the bowling ball (4) to provide a friction fit.

The first material is selected to provide a predetermined degree of tactile friction to the removal of a thumb or finger (8) from the opening (5) when an operative grip is assumed on the bowling ball (4). The second material is selected to provide a predetermined degree of resistance to the withdrawal of a finger or thumb (8) from the opening. The first material is thus selected to allow a good grip to be assumed on the ball (4), while the second material is selected to allow ease of release of the thumb or finger from the opening. This latter feature minimises abrasion of the skin (9) of the thumb or finger when the ball leaves a bowler's hand.

The hardness of the material is used as a primary parameter in providing the required tactile feel. The surface finish used on the thumb or finger pad also has influence however. In the described embodiments, the finish of the plug is that obtained by casting the material into a generally smoothly finished mould. The mould surface is polished but not ground. The final finish of the hole is that left by a conventional drill bit used to drill out the plug.

It has been found that urethane provides a suitable base for the construction of both the first and the second material. Rubber is used to assist in achieving the desired result.

In order to quantify the properties of the materials used, it has been found that hardness measured on the Shore scale provides the most convenient comparison. The first material is selected to have a Shore scale hardness of between 40A and 120A, and preferably between 60A and 80A. The second material is selected to have a Shore scale hardness of between 50D and 90D, and preferably between 60D and 80D. The degree of hardness within preferred ranges is a question of selection according to a bowler's style and technique. It is envisaged that a range of soft, medium and hard padded inserts will be provided.

The compound "urethane E800", supplied by CH Chemicals in the Republic of South Africa, is suitable for the first material, and that the compound "urethane E838H", supplied by the same manufacturer, is suitable for the second material.

The urethane base compound of the second material is cast in a heated mould, allowed to set to hardness and removed from the mould. Hereafter, the release agent with which the mould was lined is machined off. The plug is placed in a second mould and the urethane based compound of the first material, together with a cross-linker, "5052" by C H Chemicals, is then cast. Once set to hardness, the plug is removed from the mould and the ends are cleaned up. The plug so obtained is either packaged and sold, or drilled to have a thumb or finger opening.

Figure 2:
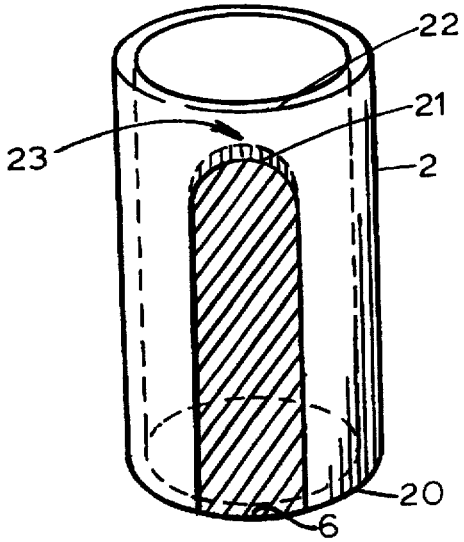
FIG. 2 is an isometric view of a second embodiment of a thumb or finger grip.
Figure 3:
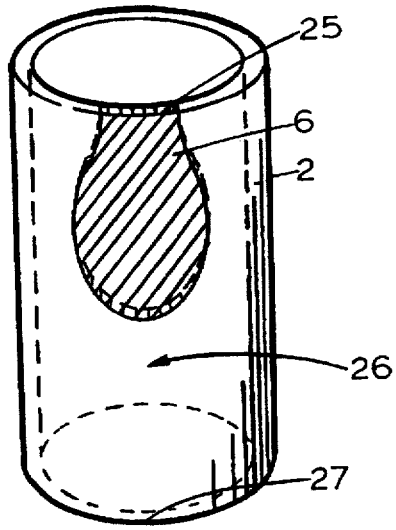
FIG. 3 is an isometric view of a third embodiment of a thumb or finger grip.
Figure 4:
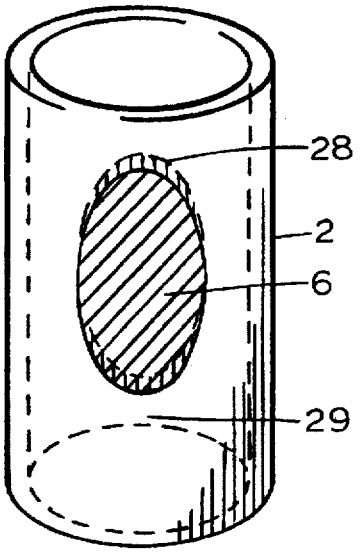
FIG. 4 is a fourth embodiment of a thumb or finger grip.

Referring to FIGS. 2, 3 and 4, the same numerals indicate the same generic elements as described with reference to FIG. 1. The thumb or finger pad (6) need not be in the form of a strip extending the length of the body (2). As shown in FIG. 2, the thumb or finger pad (6) is a strip extending from a first end (20) of the body, and up the length thereof to terminate at a position (21) spaced apart from the second end (22) of the body (2) so that a bridge (23) of harder material exists between the thumb or finger pad (6) and the second end (22). In this embodiment either the first end (20) or the second end (22) can be uppermost when the body is inserted into a bowling ball (4). When the first end is uppermost, the thumb or finger pad (6) tends to be adjacent the entire length of the thumb or finger (8) including the web between thumb or finger and hand. Thus a large area of grip is provided. The converse applies when the second side is operatively uppermost. Here the web between thumb or finger and hand contacts the harder second material and less grip is provided.

As shown in FIG. 3, the finger pad (6) is ovoid and extends from a first end (23) to terminate up the length of the body to have a large bridge (26) of harder second material between the thumb or finger pad (6) and the second end (27). As described with reference to FIG. 2, either end of the body (2) can be operatively uppermost, depending on the grip characteristics required.

Referring to FIG. 4, the thumb or finger pad (6) can be an oval shaped insert in the body having a bridge (28, 29) of harder second material at each end. It will be appreciated, however, that many other shapes of thumb or finger pad can be used, and that the thumbs or finger pad need not extend from the outer surface (11 ) of the body (2) to the inner surface (10) of the opening (5).

Figure 5:
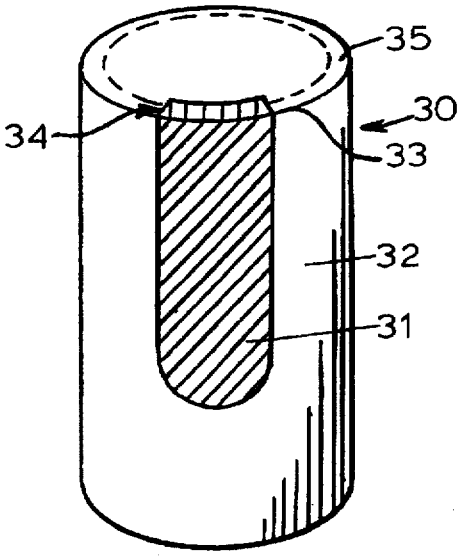
FIG. 5 is an isometric view of a first embodiment of a plug.

Referring to FIG. 5, a plug (30) made of a first material (31) and a second material (32), and in which a hole (indicated by a broken line) can be created to form a thumb or finger grip substantially as described above. The hole can be conveniently created by drilling. The selection of construction material is important, especially that of the first material, as too soft a material will tend to tear when drilled. Also, the shape of the segment of first material is important for convenience of drilling.

In the embodiment shown, the first material extends from the outer surface (33) of the plug (30) towards the longitudinal axis of the plug (30) and has a thickness (34) slightly greater than that of the wall (34) of the plug when a hole (indicated by a broken line) is formed in the plug. When drilled, the harder second material (32) tends to guide the drill and allow it to obtain proper purchase. If the first material extends too far towards the centre of the plug, a uniform hole cannot be easily drilled in the plug.

Figure 6:
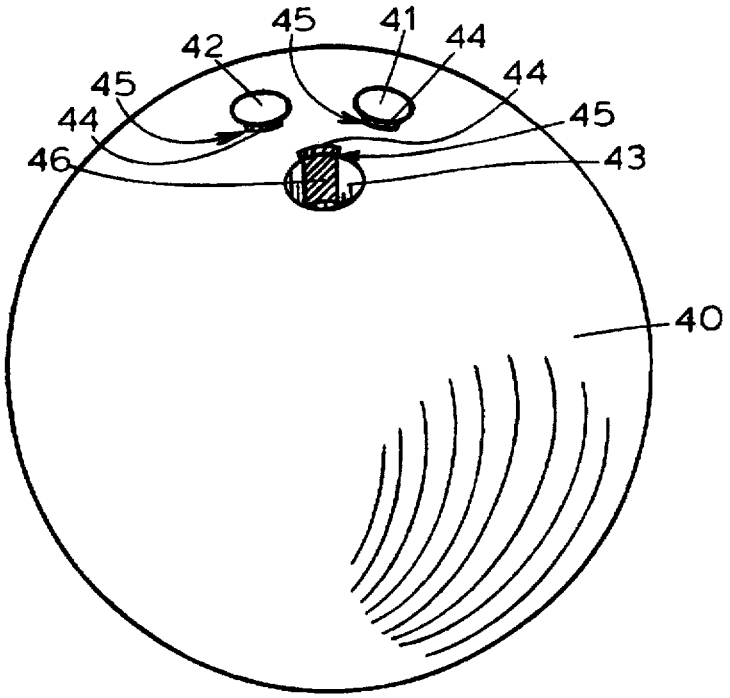
FIG. 6 is an isometric view of a bowling ball having holes fitted with thumb/finger pads according to the present invention.

Referring to FIG. 6, a bowling ball (40) having two finger openings (41, 42) and a thumb opening (43), each opening having a thumb or fingerpad (44) substantially as described above, is provided.

In the embodiment shown, a longitudinally extending groove (45) is created in each hole (41, 42 and 43) and a strip (46) of a first material fixed therein, conveniently by means of an adhesive. The respective grooves (45) can be created by machining or be performed when the ball (40) is manufactured.

If desired, a strip of a second material (not shown) can similarly be fixed opposite the strip of the first material (46) to allow ease of release of fingers or thumbs from the opening.

Variations may be made to the above embodiments without departing from the scope of the invention. For example, the accessory may be injection moulded or cast with the hole present, or as a solid plug. It will be appreciated that a variety of inserts of the invention may be provided to suit fingers and thumbs according to a bowler's needs. The surface finish of the pad and the remainder of the hole may be rougher or smoother to a bowler's taste.

What we claim as new and desire to secure by Letters Patent is:

1. A bowling accessory for a bowling ball comprising: an elongate body securable within a hole in a bowling ball, the body having a thumb opening extending longitudinally therein, the thumb opening defined by an inner surface of the body; and a thumb pad disposed at the inner surface of the body within the thumb opening defining a first thumb-contacting surface comprising a first material select to provide a predetermined degree of tactile friction;

wherein the inner surface of the body further comprises a second thumb-contacting surface comprising a second material selected to provide less tactile friction than the first material.

2. A bowling accessory as claimed in claim 1 in which the first material and the second material are plastics materials.

3. A bowling accessory as claimed in claim 1 in which the first material is softer than the second material.

4. A bowling accessory as claimed in claim 3 in which the first material has a Shore scale hardness of between 40A and 120A.

5. A bowling accessory as claimed in claim 4 in which the first material has a Shore scale hardness of between 60A and 80A.

6. A bowling accessory as claimed in claim 1 in which the first material is urethane based.

7. A bowling accessory as claimed in claim 1 in which the second material has a Shore scale hardness of between 50D and 90D.

8. A bowling accessory as claimed in claim 7 in which the second material has a Shore scale hardness of between 60D and 80D.

9. A bowling accessory as claimed in claim 1 in which the second material is urethane based.

10. A bowling accessory as claimed in claim 1 in which the body is circular in cross section.

11. A bowling accessory as claimed in claim 1 in which the pad extends the length of the thumb opening.

12. A bowling accessory as claimed in claim 1 in which the body consists of the first material and the second material.

13. A bowling accessory as claimed in claim 1 in which the pad extends from the inner surface of the opening to the outer surface of the body.

14. A bowling accessory as claimed in claim 1 in which the pad extends a portion of the length of the body.

15. A bowling accessory as claimed in claim 1 in which the inner surface of the body has a generally smooth finish.

16. An elongate plug sized to fit securably within a hole in a bowling ball, the elongate plug having an outer surface and a longitudinal axis and comprising:

a first portion extending from substantially the outer surface of the elongate plug toward the longitudinal axis of the elongate plug and comprising a first material selected to provide a predetermined degree of tactile friction; and a second portion comprising a second material selected to provide less than said predetermined degree of tactile friction;

wherein a thumb hole can by made in the elongate plug such that the thumb hole intersects the first and second portions to provide corresponding first and second thumb-contacting surfaces.

17. A plug as claimed in claim 16 in which the first material is softer than the second material.

18. A plug as claimed in claim 17 in which the first material has a hardness on the Shore scale of between 40A and 120A.

19. A plug as claimed in claim 18 in which the first material has a hardness on the Shore scale of between 60A and 80A.

20. A plug as claimed in claim 16 in which the first material is urethane based.

21. A plug as claimed in claim 18 in which the second material has a hardness on the Shore scale of between 50D and 90D.

22. A plug as claimed in claim 21 in which the second material has a hardness on the Shore scale of between 60D and 80D.

23. A plug as claimed in claim 16 in which the second material is urethane based.

24. A plug as claimed in claim 16 in the form of a right circular cylinder.

25. A hole therein and comprising:

an elongate body secured within the hole, the body having a thumb opening extending longitudinally therein, the thumb opening defined by an inner surface of the body; and a thumb pad disposed at the inner surface of the body within the thumb opening and defining a first thumb-contacting surface comprising a first material selected to provide a predetermined degree of tactile friction, and wherein the inner surface of the body comprises a second thumb-contacting surface comprising a second material selected to provide less than the predetermined degree of friction.

* * * * *

UNITED STATES PATENT AND TRADEMARK OFFICE

CERTIFICATE OF CORRECTION

PATENT NO. : 5,704,843

DATED : January 6, 1998

INVENTOR(S) : Oosterlaak et al.

It is certified that error appears in the above-identified patent and that said Letters Patent is hereby corrected as shown below:

Column 5, line 41, "select" should be --selected--.

Column 6, line 50, before "a hole" add --A bowling ball having-.

Signed and Sealed this

Seventeenth Day of November, 1998

Bruce Lehman

*Attest:*

BRUCE LEHMAN

*Attesting Officer*

*Commissioner of Patents and Trademarks*